US010502498B2

(12) United States Patent
Huang et al.

(10) Patent No.: US 10,502,498 B2
(45) Date of Patent: Dec. 10, 2019

(54) SLIM VAPOR CHAMBER

(71) Applicant: DELTA ELECTRONICS, INC., Taoyuan (TW)

(72) Inventors: Shih-Lin Huang, Taoyuan (TW); Ting-Yuan Wu, Taoyuan (TW); Chiu-Kung Chen, Taoyuan (TW); Chun-Lung Chiu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 398 days.

(21) Appl. No.: 15/215,084

(22) Filed: Jul. 20, 2016

(65) Prior Publication Data

US 2017/0023308 A1 Jan. 26, 2017

Related U.S. Application Data

(60) Provisional application No. 62/194,431, filed on Jul. 20, 2015.

(30) Foreign Application Priority Data

Jul. 15, 2016 (CN) ..... 2016 1 0560393

(51) Int. Cl.

| | |
|---|---|
| ***F28D 15/04*** | (2006.01) |
| ***F28F 3/00*** | (2006.01) |
| ***F28F 13/06*** | (2006.01) |
| *F28D 21/00* | (2006.01) |

(52) U.S. Cl.

CPC ..... *F28D 15/046* (2013.01); *F28F 3/00* (2013.01); *F28F 13/06* (2013.01); *F28D 2021/0028* (2013.01); *F28F 2225/04* (2013.01); *F28F 2255/18* (2013.01)

(58) Field of Classification Search

CPC ..... H01L 23/427; F28D 15/0233; F28D 15/0266; F28D 15/046; F28F 3/00; F28F 13/06; F28F 9/0075

See application file for complete search history.

(56) References Cited

U.S. PATENT DOCUMENTS

| | | | | |
|---|---|---|---|---|
| 6,227,287 | B1 * | 5/2001 | Tanaka | F28D 15/0233 165/104.26 |
| 2008/0236795 | A1 * | 10/2008 | You | H01L 23/427 165/104.21 |
| 2010/0243214 | A1 * | 9/2010 | Moon | F28D 15/0233 165/104.26 |

(Continued)

FOREIGN PATENT DOCUMENTS

| | | |
|---|---|---|
| CN | 2762508 Y | 3/2006 |
| CN | 102019543 A | 4/2011 |

(Continued)

*Primary Examiner* — Tho V Duong

(74) *Attorney, Agent, or Firm* — Muncy, Geissler, Olds & Lowe, P.C.

(57) ABSTRACT

A slim vapor chamber includes a first plate, a second plate and a capillary structure. The periphery of the second plate is connected with that of the first plate to form a chamber. The capillary structure is disposed in the chamber. At least one of a side of the first plate facing the second plate and a side of the second plate facing the first plate is formed with a plurality of supporting structures, which include a plurality of supporting pillars and a plurality of supporting plates, by an etching process.

17 Claims, 13 Drawing Sheets

(56) References Cited

U.S. PATENT DOCUMENTS

| | | | | |
|---|---|---|---|---|
| 2012/0227936 | A1* | 9/2012 | Yang | B05D 5/04 165/104.26 |
| 2013/0126139 | A1* | 5/2013 | Tsuruta | F28D 15/0233 165/170 |
| 2015/0119111 | A1* | 4/2015 | Honmura | G06F 1/203 455/566 |
| 2015/0181764 | A1* | 6/2015 | Honmura | H05K 7/20336 165/104.26 |
| 2016/0209122 | A1* | 7/2016 | Wang | F28D 15/0233 |
| 2017/0023307 | A1* | 1/2017 | Wang | F28D 15/04 |

FOREIGN PATENT DOCUMENTS

| | | | | | |
|---|---|---|---|---|---|
| CN | 104976910 | A | | 10/2015 | |
| JP | 11193994 | A | * | 7/1999 | F28D 15/0233 |
| JP | 2001255085 | A | * | 9/2001 | F28D 15/0233 |
| JP | 2007150013 | A | * | 6/2007 | F28D 15/0233 |

* cited by examiner

SLIM VAPOR CHAMBER

CROSS REFERENCE TO RELATED APPLICATIONS

This application claims the priority benefits of U.S. provisional application Ser. No. 62/194,431, filed on Jul. 20, 2015 and under 35 U.S.C. § 119(a) on Patent Application No(s). 201610560393.0 filed in People's Republic of China on Jul. 15, 2016. The entirety of the above-mentioned patent applications are hereby incorporated by references herein and made a part of specification.

BACKGROUND OF THE INVENTION

Field of Invention

The present invention relates to a heat conductive device, and in particular, to a slim vapor chamber.

Related Art

As the progress of technology, the electronic products are developed toward the features of portable, light weight, 4K resolution, 4G transmission and high attachment function. However, when the high performance electronic product is operating, a lot of heat will be generated. If the heat conducting component and/or the heat-dissipating component is not upgraded, the internal components of the electronic products can be damaged by the generated heat, thereby decreasing the performance or lifetime of the products.

Regarding to the heat conducting and/or heat dissipating issue of the high performance electronic products, the heat conducting technology of a vapor chamber has been introduced. In more detailed, the generated heat can be carried away by the phase change and flow of the working fluid in the vapor chamber. Then, the heat is transferred and dissipated at the condenser section. Afterwards, the working fluid flows back to the heat source through the capillary structure. The cycle of the working fluid can continuously take the heat away from the heat source, and the heat dissipation ability of this system is superior to other heat-dissipating components in the same size. Since the electronic products are manufactured with a thinner shape, the vapor chamber must be thinner. However, the thinner vapor chamber has a smaller internal space for the flowing vapor since the dimensions of the capillary structure and the fluid pipe are not changed. This smaller internal space will decrease the flowing speed of the vapor, thereby reducing the heat conducting ability. This is an important issue for developing the thinner vapor chamber.

In general, the conventional vapor chamber is manufactured by multiple assembling processes. For example, the copper mesh and the supporting pillars are fixed, and then the upper and lower cases are combined. Afterwards, the injection pipe is welded followed by filling the working fluid with positive or negative pressure so as to finish the vapor chamber. However, the placement and positioning of the supporting pillars are difficult. In practice, the supporting pillars may be misaligned in the assembling process, which will affect the flowing the vapor and thus decrease the performance of the vapor chamber. In addition, the flow of the vapor is a kind of non-directional (the flowing direction of the vapor is not consistent), so the temperature difference between the heat and cold ends of the vapor chamber is obvious. Accordingly, the vapor flow cannot be properly guided to improve the heat conducting efficiency as the vapor chamber is thinner.

Therefore, it is an important subject to provide a slim vapor chamber that can improve the flow speed of the evaporated working fluid so as to enhance the heat conducting efficiency.

SUMMARY OF THE INVENTION

In view of the foregoing, an objective of the present invention is to provide a slim vapor chamber that can improve the flow speed of the evaporated working fluid so as to enhance the heat conducting efficiency.

To achieve the above objective, the present invention discloses a slim vapor chamber, which includes a first plate, a second plate and a capillary structure. A periphery of the second plate is connected with a periphery of the first plate to form a chamber. The capillary structure is disposed on an inner wall of the chamber. At least one of a side of the first plate facing the second plate and a side of the second plate facing the first plate is formed with a plurality of supporting structures by an etching process. The supporting structures include a plurality of supporting pillars and a plurality of supporting plates.

In one embodiment, when both of the side of the first plate facing the second plate and the side of the second plate facing the first plate are formed with a plurality of supporting structures by the etching process, the supporting structures formed on the first plate are contacted against the supporting structures formed on the second plate. Alternatively, when both of the side of the first plate facing the second plate and the side of the second plate facing the first plate are formed with a plurality of supporting structures by the etching process, the supporting structures formed on the first plate are contacted against the second plate, and the supporting structures formed on the second plate are contacted against the first plate.

In one embodiment, when one of the side of the first plate facing the second plate and the side of the second plate facing the first plate is formed with a plurality of supporting structures by the etching process, the supporting structures formed on the first/second plate are contacted against the capillary structure or the second/first plate.

In one embodiment, the supporting structures are located within two regions. Herein, the supporting pillars are configured in one of the regions, and the supporting plates are configured in the other region.

In one embodiment, the supporting structures are a combination of the supporting pillars and the supporting plates. Herein, the supporting plates are arranged in rows, and the supporting pillars are disposed in intervals of the rows of the supporting plates.

In one embodiment, the intervals of the rows of the supporting plates are ranged from 3 mm to 30 mm.

In one embodiment, the supporting pillars are column pillars, cone pillars or reversed cone pillars.

In one embodiment, a cross-section of the supporting pillar is circular, elliptic, triangular, rectangular, rhombic, trapezoidal, or polygonal.

In one embodiment, the capillary structure is formed by a sintering process with a woven metal mesh or a metal powder.

In one embodiment, the thickness of the slim vapor chamber is ranged from 0.2 mm to 0.6 mm.

As mentioned above, the slim vapor chamber of the invention has a first plate and a second plate, and a side of the first plate facing the second plate and/or a side of the second plate facing the first plate is formed with a plurality of supporting structures, which include a plurality of supporting pillars and a plurality of supporting plates, by an etching process. Accordingly, the flowing speed of the evaporated working fluid can be increased, so that the heat conducting speed between the two plates can be improved so as to enhance the heat conducting ability. Therefore, the vapor chamber can have a thinner size and a good heat conducting efficiency, thereby providing a better heat conducting ability to the electronic product.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

Figure 1A:
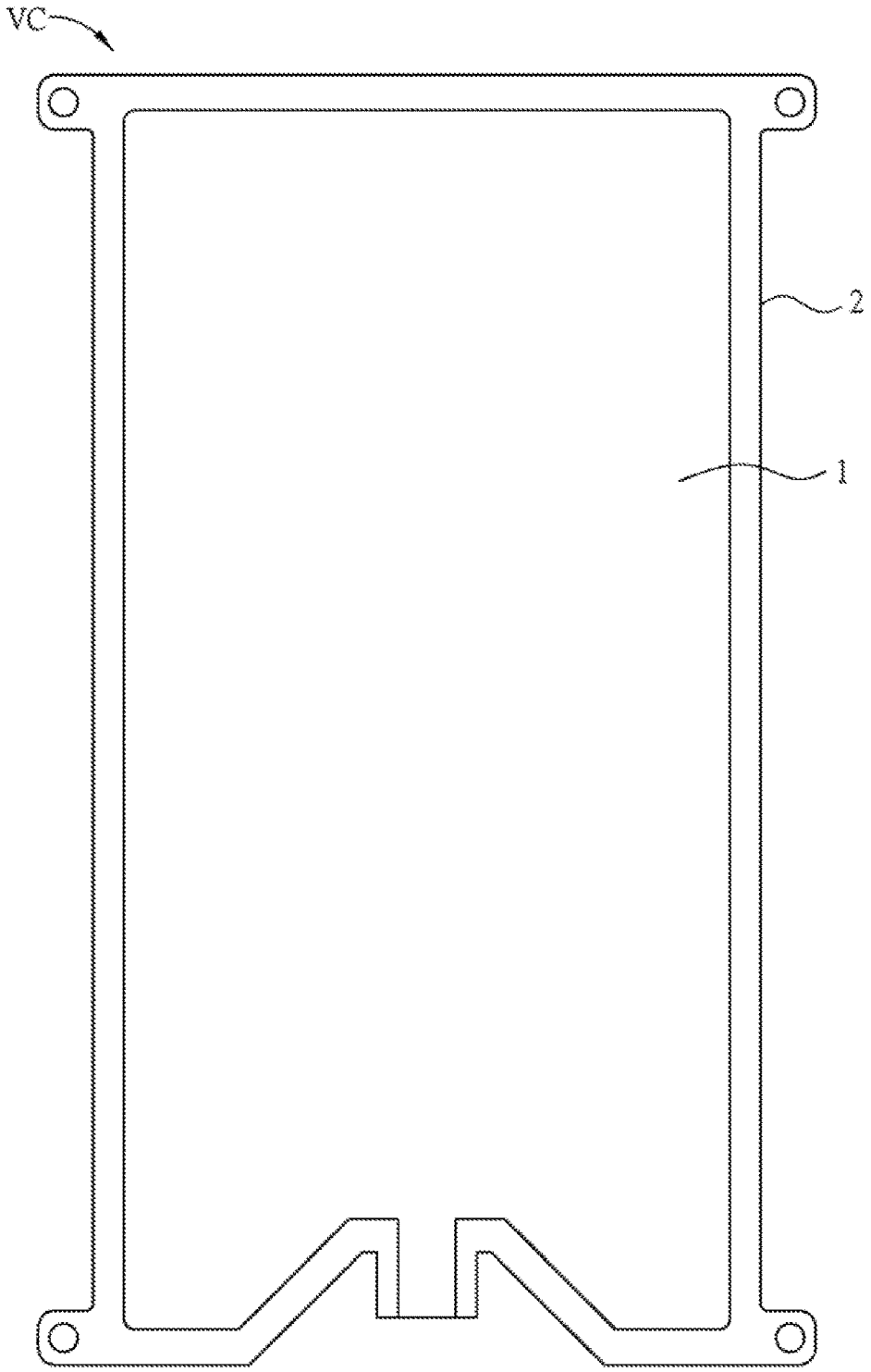
FIG. 1A is a top view of a slim vapor chamber according to an embodiment of the invention.

The embodiments of the invention will be apparent from the following detailed description, which proceeds with reference to the accompanying drawings, wherein the same references relate to the same elements. Moreover, the drawings of all implementation are schematic, and they do not mean the actual size and proportion. The terms of direction recited in the disclosure, for example up, down, left, right, front, or rear, only define the directions according to the accompanying drawings for the convenience of explanation but not for limitation. The names of elements and the wording recited in the disclosure all have ordinary meanings in the art unless otherwise stated. Therefore, a person skilled in the art can unambiguously understand their meanings. In the drawings, the sizes of the arrows represent the flowing speeds of the working fluid (or vapor) in the chamber, and the directions of the arrows represent the flowing direction of the working fluid (or vapor) in the chamber.

Figure 1B:
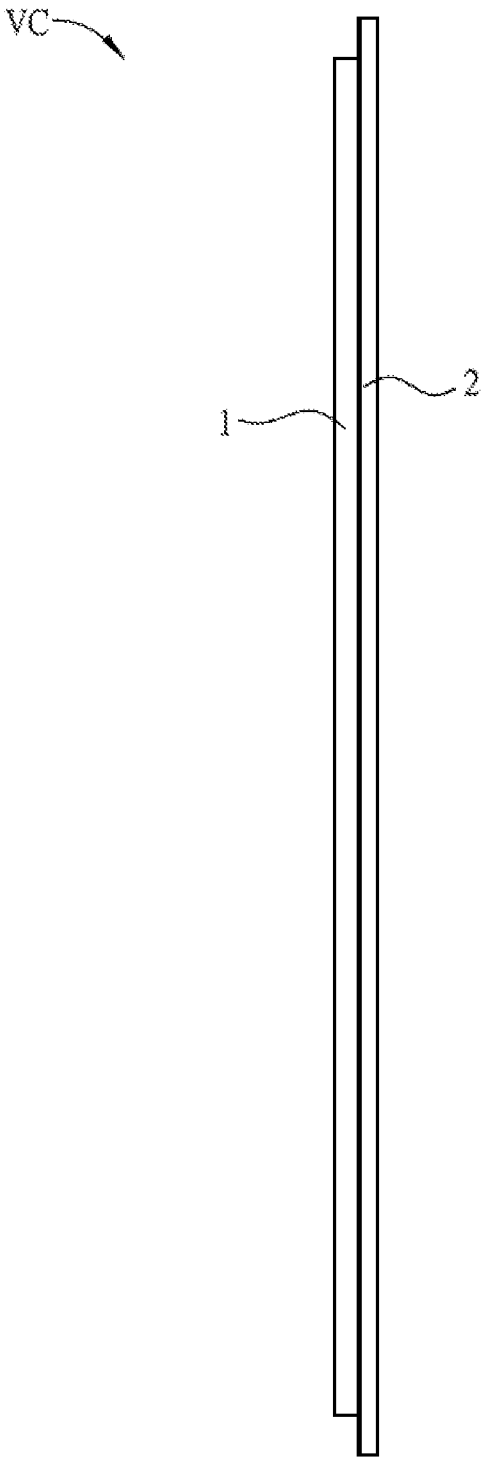
FIG. 1B is a side view of the slim vapor chamber according to the embodiment of the invention.
Figure 3A:
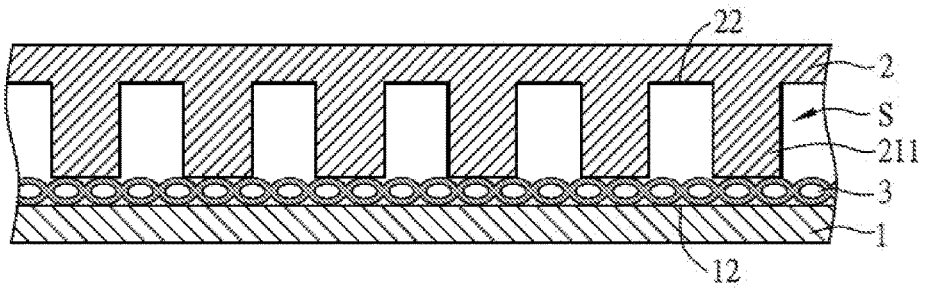
FIG. 3A is a sectional view of the slim vapor chamber according to the embodiment of the invention.
Figure 4A:
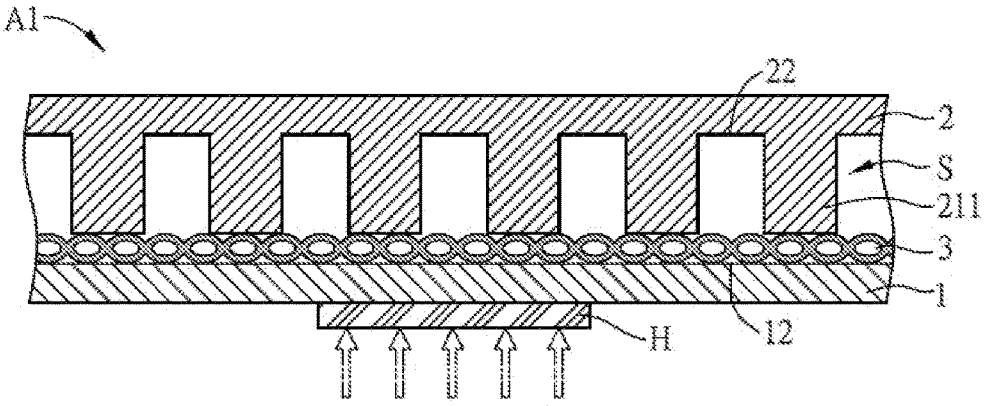
FIGS. 4A, 4B and 4C are schematic diagrams showing the heat flow direction in the first region according to the embodiment of the invention.
Figure 4B:
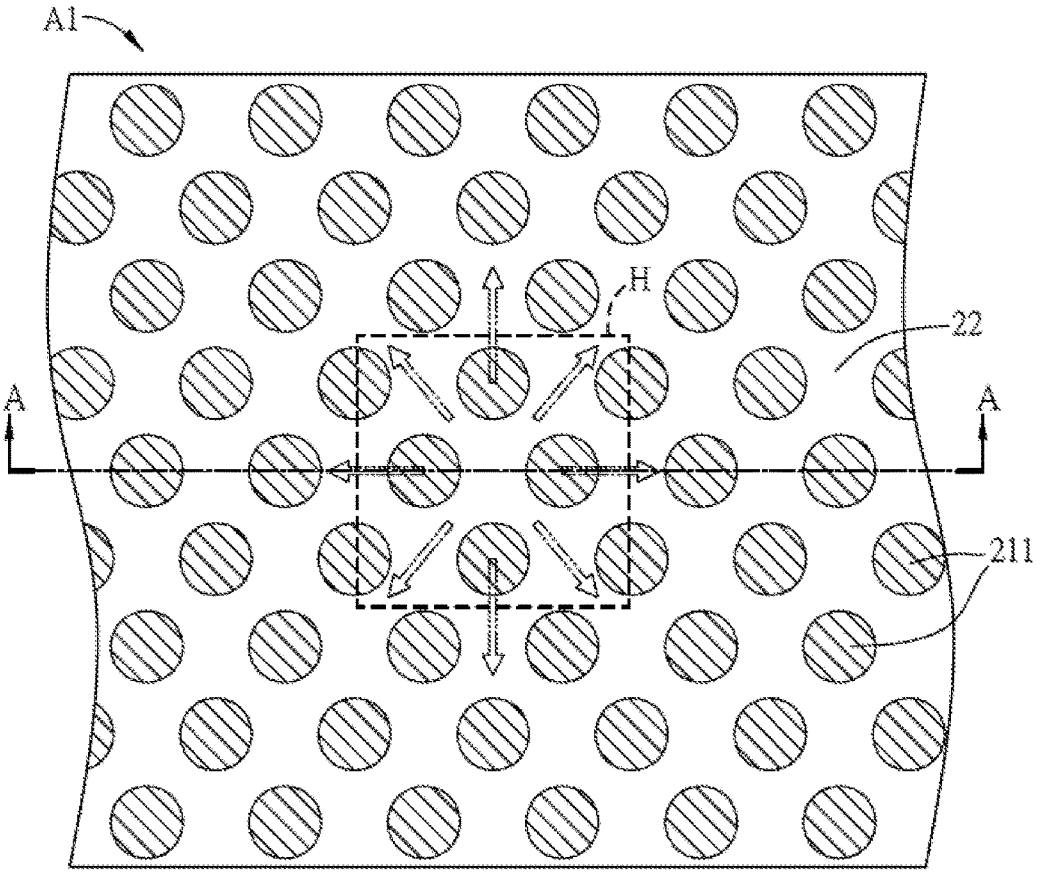

FIG. 1A is a top view of a slim vapor chamber VC according to an embodiment of the invention, and FIG. 1B is a side view of the slim vapor chamber VC according to the embodiment of the invention. As shown in FIGS. 1A and 1B, the slim vapor chamber VC includes a first plate 1 and a second plate 2. The periphery of the second plate 2 is connected with that of the first plate 1 to form a chamber S, as shown in FIG. 3A. The chamber S is filled with a working fluid (not shown), and the pressure in the chamber S is reduced to vacuum or almost vacuum. When the slim vapor chamber VC is installed on a heat source H as shown in FIGS. 4A and 4B, the heat is conducted into the chamber S, and the working fluid in the chamber S is heated and evaporated to bring the heat away. After flowing into the vacuum chamber S, the liquid working fluid will be evaporated and the volume thereof will rapidly expand and fulfill the chamber S. When the working fluid vapor contacts the condenser section, such as the fan, heat sink or water cooling system, the absorbed heat is released and the working fluid vapor is condensed. Then, the condensed liquid working fluid flows back to the heat source H through the capillary structure. As mentioned above, the phase cycle of the working fluid is repeated in the chamber S to continuously carry the heat away.

Figure 2:
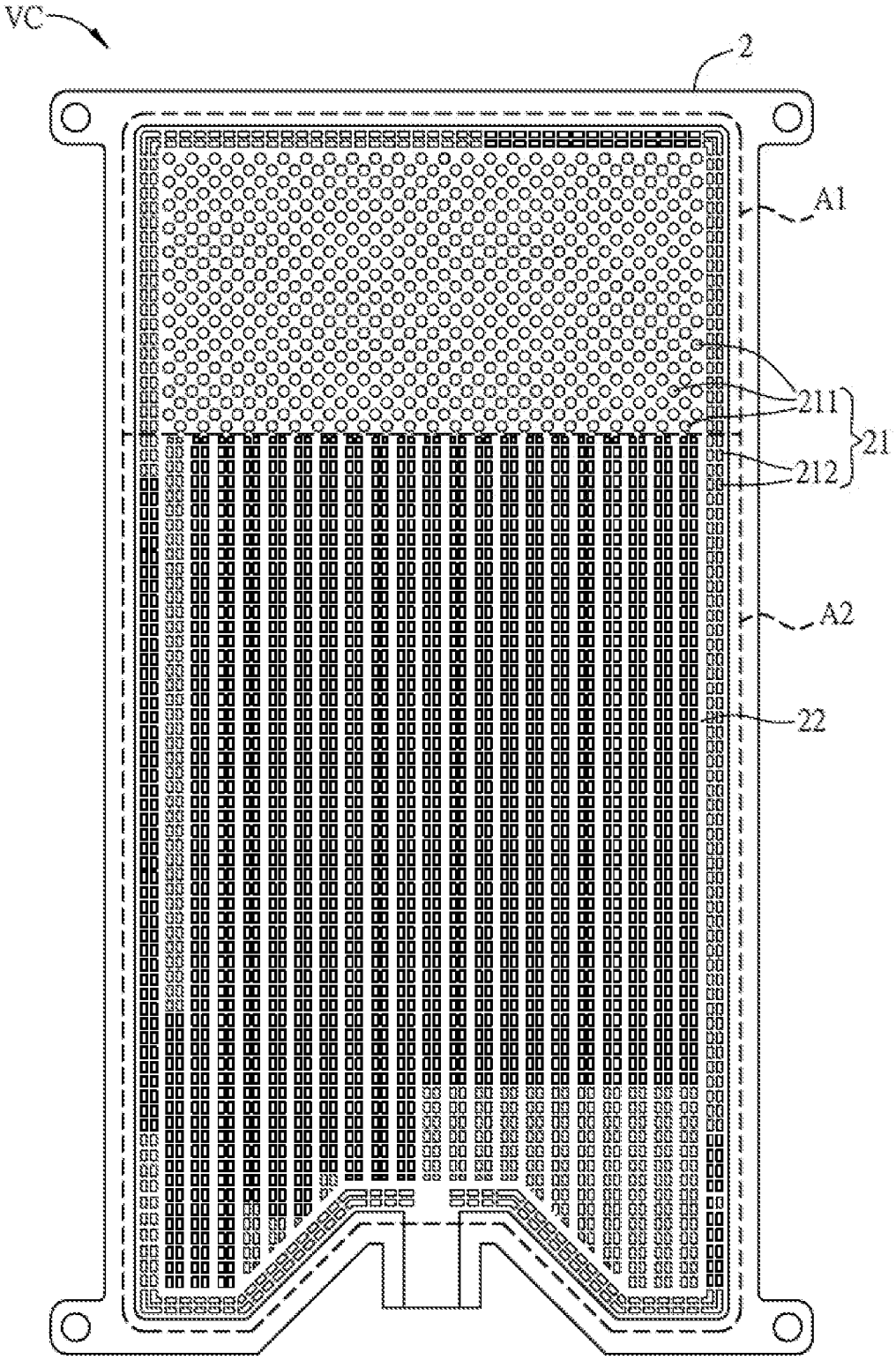
FIG. 2 is top view of a second plate according to the embodiment of the invention.

FIG. 2 is top view of the second plate 2 of the slim vapor chamber VC according to the embodiment of the invention. The second plate 2 includes a plurality of supporting structure 21 and a second side wall 22. Besides, the second plate 2 has a first region A1 located close to the heat source and a second region A2 for guiding the working fluid vapor to the condenser section. The second side wall 22 is a side of the second plate 2 facing the first plate 1. That is, the second side wall 22 is disposed at the inner side of the slim vapor chamber VC. The supporting structures 21 are protrusion configurations formed on the second side wall 22 of the second plate 2 for supporting the first plate 1. Accordingly, the space between the first plate 1 and the second plate 2 can be kept as the chamber S and not shrunk during the vacuum process of the fabrication of the slim vapor chamber VC. Thus, the heated working fluid can be rapidly evaporated and conducting the heat to the condenser section. In this embodiment, the supporting structures 21 in the first region A1 include a plurality of supporting pillars 211 for creating the space to accommodate the expanded working fluid vapor, and the supporting structures 21 in the second region A2 include a plurality of supporting plates 212 for directing the working fluid vapor to the condenser section.

Figure 8A:
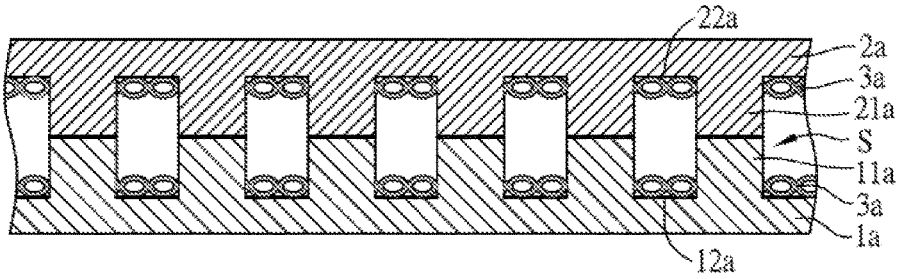
FIGS. 8A and 8B are sectional views of the first and second plates of different aspects according to another embodiment of the invention.
Figure 8B:
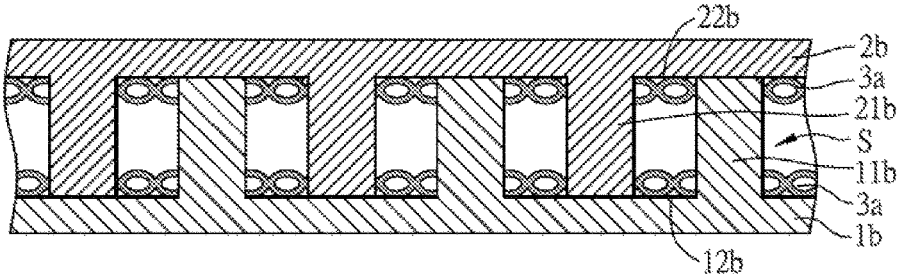

In this embodiment, the thickness of the slim vapor chamber VC is ranged from 0.2 mm to 0.6 mm. The supporting pillars 211 and the supporting plates 212 are formed by an etching process, which is not limited to a dry etching process or a wet etching process. The second plate 2, the supporting pillars 211 and the supporting plates 212 are formed as a single piece, so that the duration and lifetime of the second plate 2, the supporting pillars 211 and the supporting plates 212 can be enhanced. Compared with the conventional assembling procedures, the conductive heat resistance between the first plate 1 and the second plate 2 of this embodiment is lower, so that the heat conduction efficiency can be improved. In this embodiment, the supporting pillars 211 are column pillars, which are arranged in a plurality of rows, wherein the column pillars of adjacent two rows are misaligned and the column pillars of a previous row and a next row are aligned. The column pillar has the same shape and size in both ends thereof. To be noted, the present invention is not limited to the above arrangement and shape. In this embodiment, the supporting plates 212 are rectangular plates, which are arranged in a plurality of rows. Every two adjacent rows of the rectangular plates stand side by side to form a line, and every two adjacent lines are separated to form a channel. To be noted, the present invention is not limited to the above arrangement and shape. Alternatively, the supporting structures 21 can be disposed on the first plate 1 or on both of the first plate 1 and the second plate 2, as shown in FIGS. 8A and 8B. Besides, each row of supporting plates 212 can be replaced by a long supporting plate, which is similar to the combination of the supporting plates 212, for forming the channel.

FIG. 3A is a sectional view of the slim vapor chamber VC in the first region A1 according to the embodiment of the invention. As shown in FIG. 3A, the slim vapor chamber VC includes a capillary structure 3 disposed on the second side wall 22. The supporting structures 21 contact against the capillary structure 3. The peripheries of the first plate 1 and the second plate 2 are connected to form a chamber S, and the capillary structure 3 is located in the chamber S and disposed on the first side wall 12. The supporting structures 21 (FIG. 3A only showing in the form of the supporting pillars 211) contact against the capillary structure 3 to maintain the distance between the first plate 1 and the second plate 2. In one embodiment, the capillary structure is formed by a sintering process with a woven metal mesh or a metal powder.

Figure 4C:
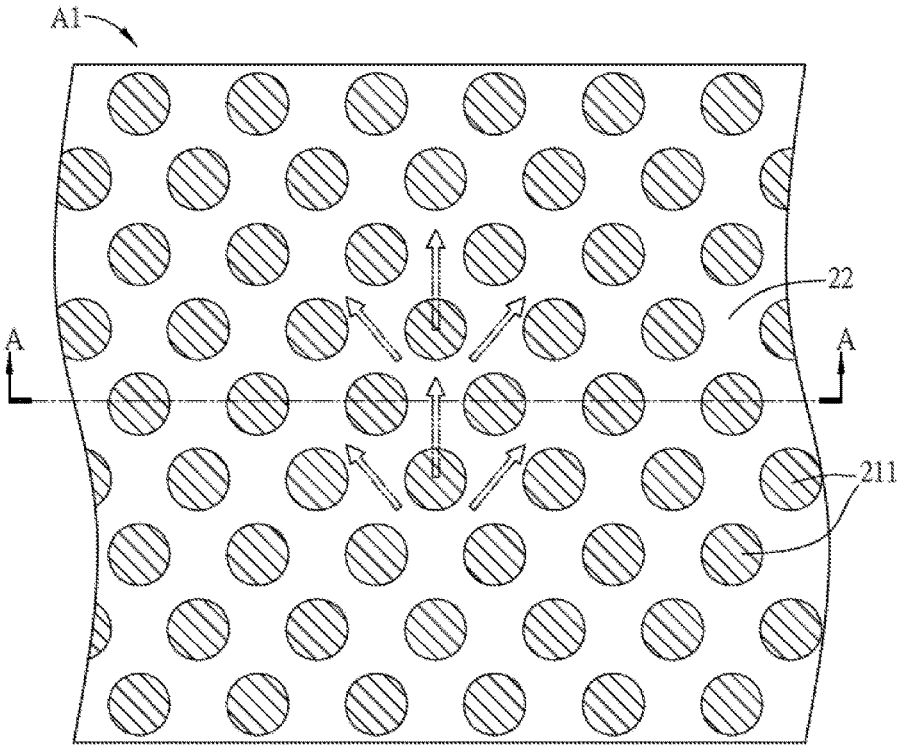
Figure 5A:
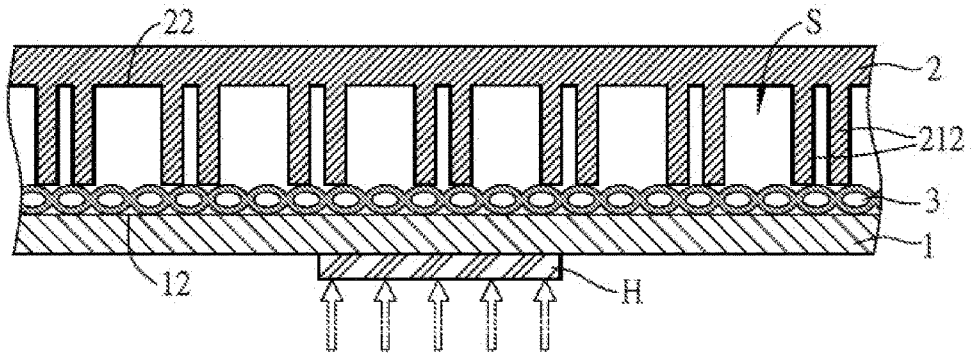
FIGS. 5A, 5B and 5C are schematic diagrams showing the heat flow direction in the second region according to the embodiment of the invention.
Figure 5B:
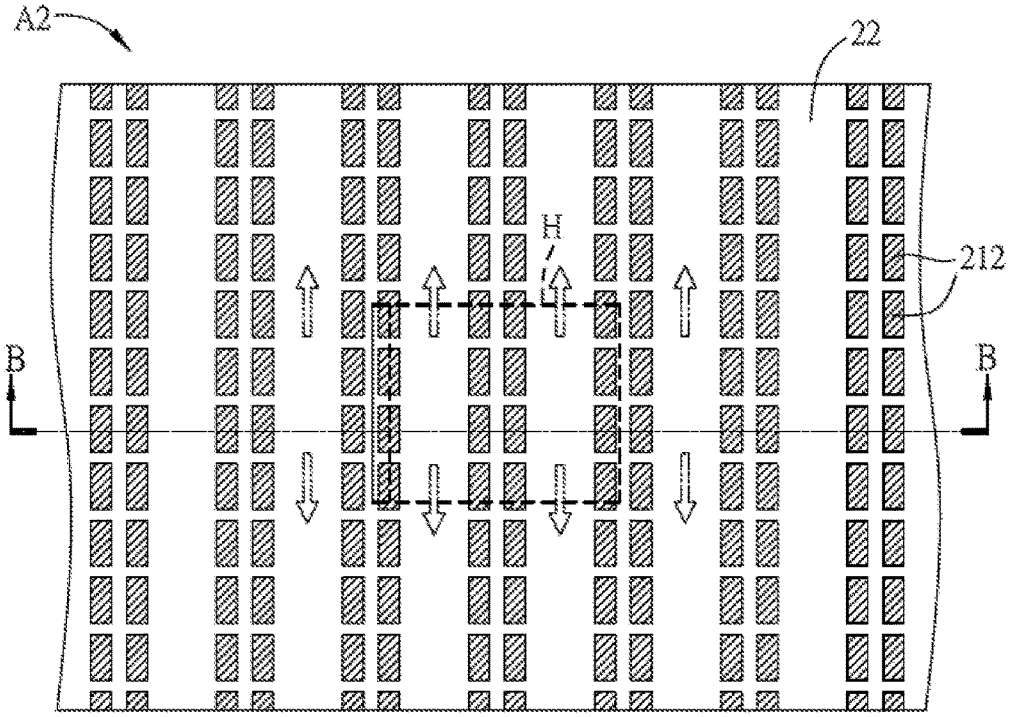
Figure 5C:
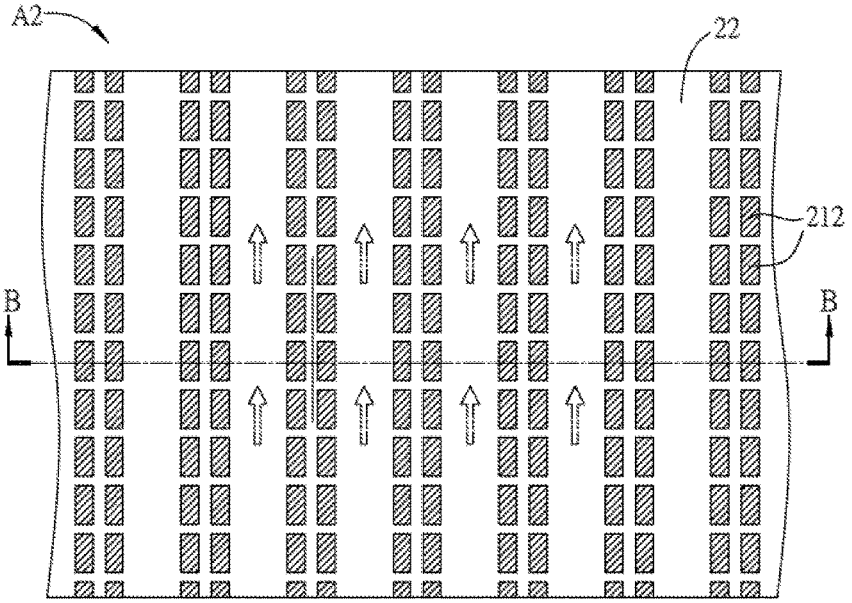

The heat conduction through the supporting pillars 211 and the supporting plates 212 will be described hereinafter, wherein the heat source H is disposed at the first region A1 or the second region. FIG. 4A is a schematic diagram showing the heat flow direction in the first region A1 according to the embodiment of the invention. With reference to FIG. 4A, the first region A1 of the slim vapor chamber VC is placed on the heat source H, so the heat will be conducted to the slim vapor chamber VC through the first plate 1. FIG. 4B is the bottom view of FIG. 4A, wherein the first plate 1, the capillary structure 3 and the heat source H are not shown and the position of the heat source H is indicated by the dotted lines. Firstly, the working fluid in the chamber S closing to the heat source H is evaporated. Then, the evaporated working fluid vapor flows to the other place as indicated by the arrows. The flowing direction of the working fluid vapor is also the heat conducting direction, which is directed to away from the heat source H, as shown in FIG. 4C. FIG. 5A is a schematic diagram showing the heat flow direction in the second region A2 according to the embodiment of the invention. As shown in FIG. 5A, the second region A2 of the slim vapor chamber VC is placed on the heat source H, so the heat will be conducted to the slim vapor chamber VC through the first plate 1. FIG. 5B is the bottom view of FIG. 5A, wherein the first plate 1, the capillary structure 3 and the heat source H are not shown and the position of the heat source H is indicated by the dotted lines. Firstly, the working fluid in the chamber S closing to the heat source H is evaporated. Then, the evaporated working fluid vapor flows along the channel defined by the supporting plates 212 as indicated by the arrows. The flowing direction of the working fluid vapor is also the heat conducting direction, which is directed to away from the heat source H, as shown in FIG. 5C.

In this embodiment, the first region A1 is placed close to the heat source. The supporting structures 21 in the first region A1 include a plurality of supporting pillars 211 for creating the space to accommodate the expanded working fluid vapor. Besides, the supporting structures 21 in the second region A2 include a plurality of supporting plates 212 for directing the working fluid vapor to the condenser section. Then, the heat is transferred and dissipated at the condenser section. Afterwards, the working fluid flows back to the heat source through the capillary structure 3. The cycle of the working fluid can continuously take the heat away from the heat source. To be noted, the shape and size of the first region A1 is not limited to the above example. In practice, the shape and size of the first region A1 can be modified according to the shape and size of the contact surface of the slim vapor chamber VC and the heat source H.

Figure 3B:
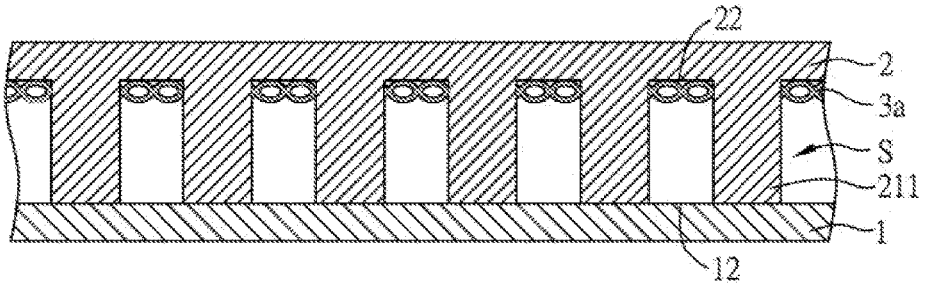
FIG. 3B is a sectional view of another aspect of the slim vapor chamber with a different arrangement of the capillary structure.

FIG. 3B is a sectional view of another aspect of the slim vapor chamber with a different arrangement of the capillary structure. In this aspect, the capillary structure 3*a* is disposed in the chamber S and located on the second side wall 22. That is, the capillary structure 3*a* is located between the supporting pillars 211, and the supporting pillars 211 directly contact against the first plate 1.

In the previous aspect, the capillary structure 3 is disposed on the inner wall of the chamber S. The capillary structure 3 is not limited to be disposed on the first side wall 12 or the second side wall 22. The first side wall 12 is a side of the first plate 1 facing the second plate 2, that is, the inner side of the slim vapor chamber VC. Besides, the supporting structures 21 can directly contact against the first side wall 12; otherwise, the supporting structures 21 directly contact against the capillary structure 3 and the capillary structure 3 further contact against the first plate 1. This invention is not limited to the above aspects, and any configuration that can keep the distance between the first plate 1 and the second plate 2 is acceptable.

Figure 6A:
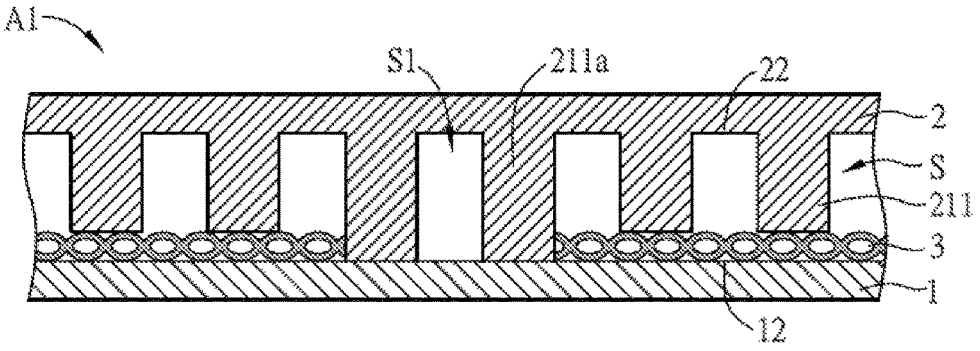
FIGS. 6A and 6B are schematic diagrams showing the heat flow direction in the first region according to another embodiment of the invention.
Figure 6B:
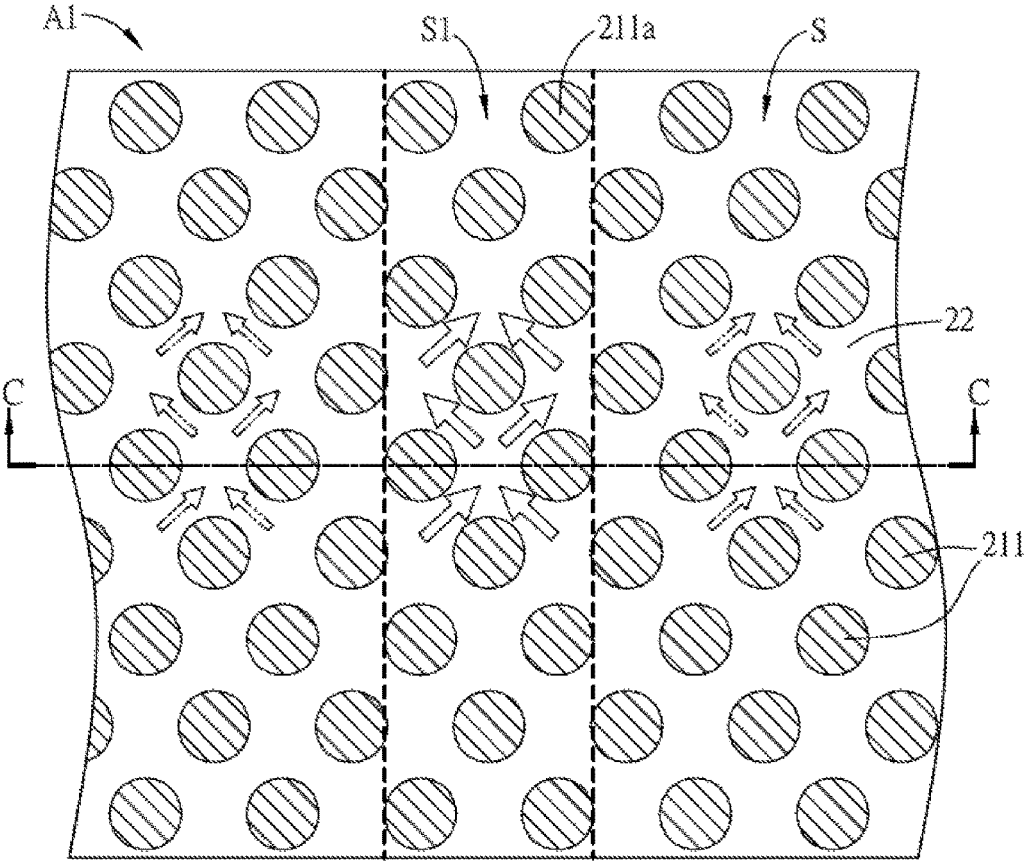

FIGS. 6A and 6B are schematic diagrams showing the heat flow direction in the first region according to another embodiment of the invention. FIG. 6A is a sectional view of the first region A1 of the slim vapor chamber VC according to another embodiment of the invention. Different from the aspect as shown in FIG. 4A, the supporting pillars 211*a* of FIG. 6A directly contact against the first plate 1 to form the chamber S1. Accordingly, the flowing speed (indicated by the sizes and directions of the arrows in FIG. 6B) of the working fluid vapor in the chamber S1 is faster than that in the chamber S.

Figure 7A:
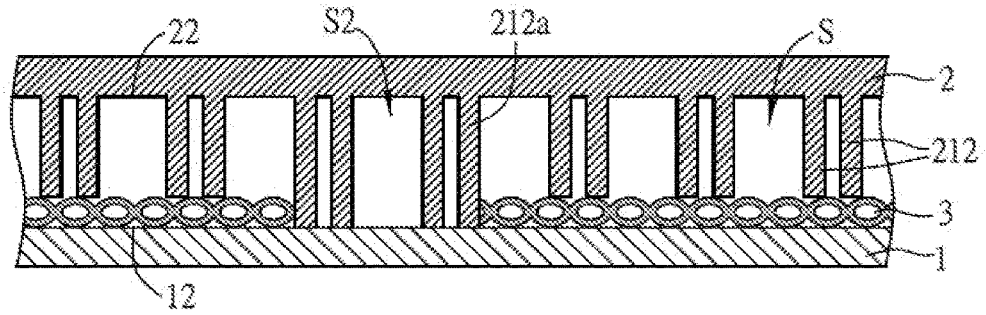
FIGS. 7A and 7B are schematic diagrams showing the heat flow direction in the second region according to another embodiment of the invention.
Figure 7B:
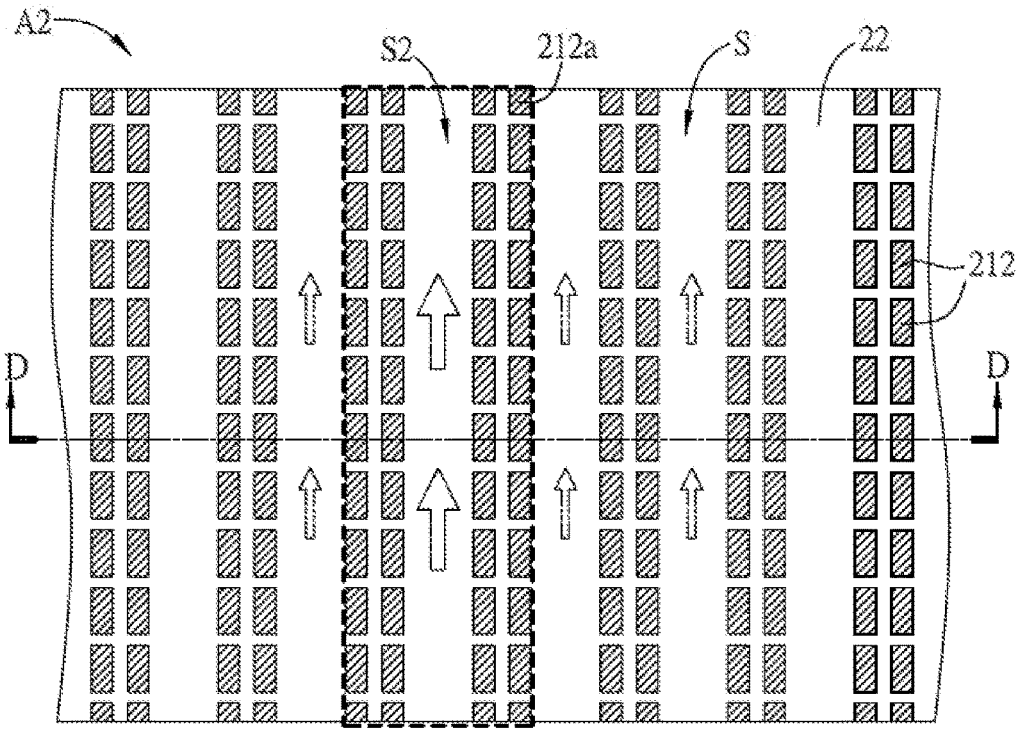

FIGS. 7A and 7B are schematic diagrams showing the heat flow direction in the second region according to another embodiment of the invention. FIG. 7A is a sectional view of the second region A2 of the slim vapor chamber VC according to another embodiment of the invention. Different from the aspect as shown in FIG. 5A, the supporting plates 212*a* of FIG. 7A directly contact against the first plate 1 to form the chamber S2. Accordingly, the flowing speed (indicated by the sizes and directions of the arrows in FIG. 7B) of the working fluid vapor in the chamber S2 is faster than that in the chamber S.

FIGS. 8A and 8B are sectional views of the first and second plates of different aspects according to another embodiment of the invention. As shown in FIG. 8A, a side of the first plate 1*a* facing the second plate 2*a* is formed with a plurality of supporting structures 11*a* by etching, and a side of the second plate 2*a* facing the first plate 1*a* is formed with a plurality of supporting structures 21*a* by etching. The supporting structures 11*a* of the first plate 1*a* contact against the supporting structures 21*a* of the second plate 2*a*. The capillary structure 3*a* is disposed on the first side wall 12*a* of the first plate 1*a* and the second side wall 22*a* of the second plate 2*a*. As shown in FIG. 8B, the first plate 1*b* is formed with a plurality of supporting structures 11*b*, and the second plate 2*b* is formed with a plurality of supporting structures 21*b*. The supporting structures 11*b* are misaligned with the supporting structures 21*b*. The supporting structures 11*b* of the first plate 1*b* contact against the second plate 2*b*, and the supporting structures 21*b* of the second plate 2*b* contact against the first plate 1*b*.

FIGS. 3A, 3B, 8A and 8B show different aspects of the invention, but this invention is not limited thereto. For example, the supporting structures can also be disposed on both of the first and second plates. In this case, the supporting structures can contact against to each other or be misaligned. Besides, the supporting structures can directly contact against the opposite plate or contact the capillary structure on the opposite plate.

Figure 9A:
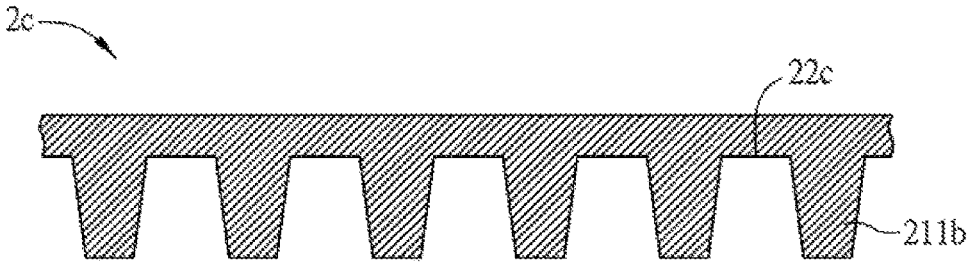
FIGS. 9A and 9B are sectional views of the supporting pillars of different aspects according to the embodiment of the invention.
Figure 9B:
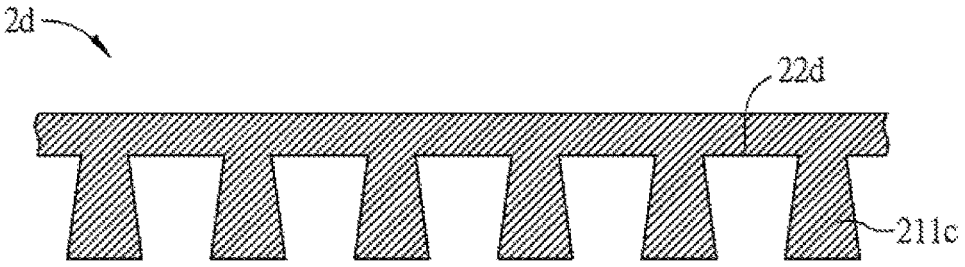

FIGS. 9A and 9B are sectional views of the supporting pillars of different aspects according to the embodiment of the invention. As shown in FIG. 9A, the second plate 2*c* is formed with a plurality of supporting pillars 211*b*, which are cone pillars. Herein, the two ends of the cone pillar have the same shape but different sizes. In more detailed, the cross-section of one end of the supporting pillar 211*b* close to the second side wall 22*c* is larger than the cross-section of the other end of the supporting pillar 211*b* contacting against the first side wall. Alternatively, as shown in FIG. 9B, the second plate 2*d* is formed with a plurality of supporting pillars 211*c*, which are reversed cone pillars. In this case, the cross-section of one end of the supporting pillar 211*c* close to the second side wall 22*d* is smaller than the cross-section of the other end of the supporting pillar 211*c* contacting against the first side wall. To be noted, the ratio of the cross-sections of the two ends of the supporting pillars can be modified according to the requirement.

The shape of the cross-section of the supporting pillar can be regular or irregular. For example, the cross-section of the supporting pillar can be, for example but not limited to, circular, elliptic, triangular, square, rectangular, rhombic, trapezoidal, or polygonal. Similarly, the cross-section of the supporting plate can be varied depending on the actual requirement.

Figure 10:
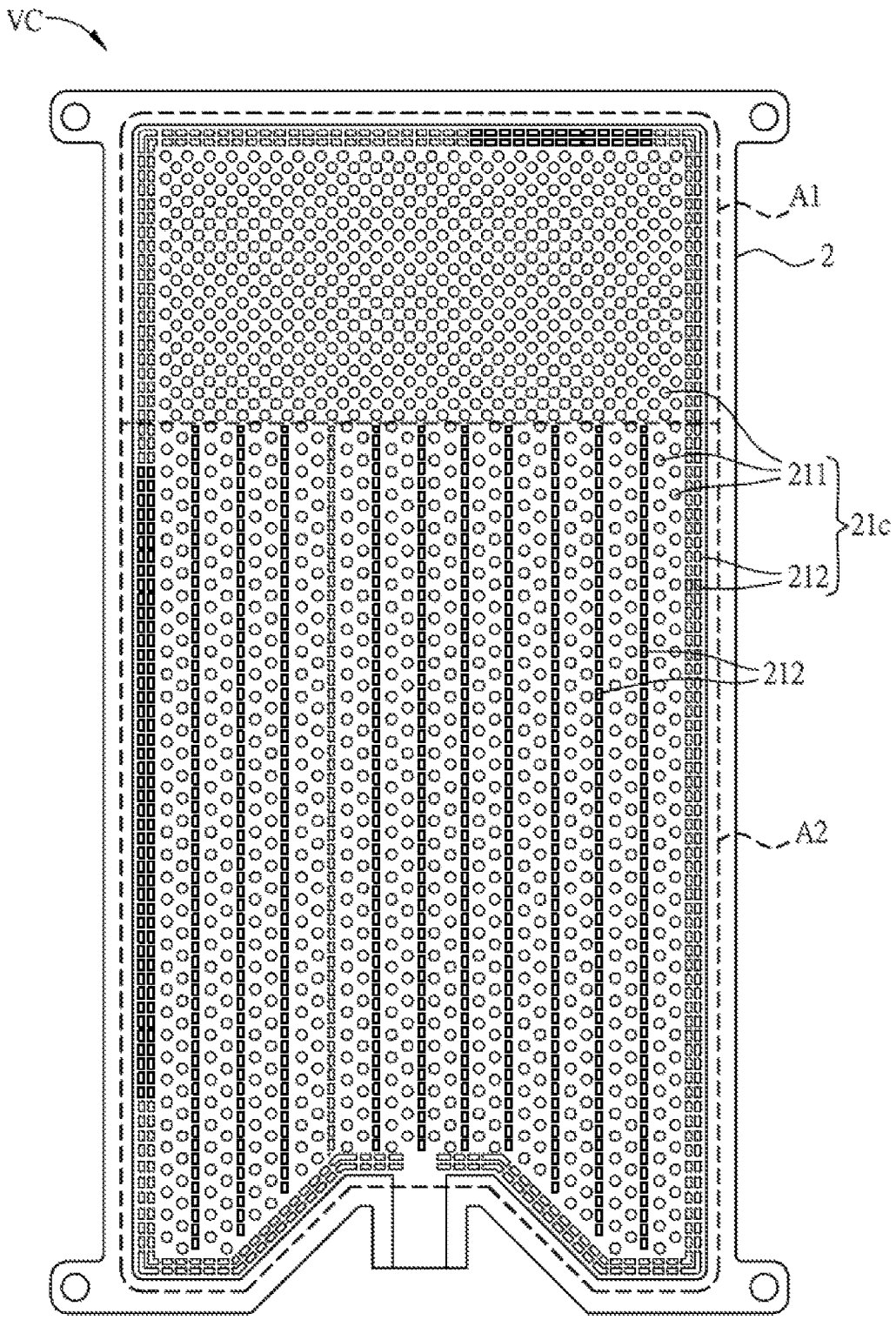
FIG. 10 is a schematic diagram showing the supporting structures of different aspects disposed in the second region according to the embodiment of the invention.

FIG. 10 is a schematic diagram showing the supporting structures of different aspects disposed in the second region A2 of the slim vapor chamber VC according to the embodiment of the invention. In this embodiment, a plurality of supporting structures 21*c* disposed in the second region A2 include a combination of a plurality of supporting pillars 211 and a plurality of supporting plates 212. Herein, the supporting plates 212 are arranged in rows with wider intervals, and the supporting pillars 211 are disposed in the intervals of the rows of the supporting plates 212. The rows of the supporting plates 212 with wider intervals can speed the heat conduction, and the configuration of the supporting pillars 211 can maintain the space between the first plate 1 and the second plate 2. The intervals of the rows of the supporting plates 212 are ranged from 3 mm to 30 mm.

In summary, the slim vapor chamber of the invention has a first plate and a second plate, and a side of the first plate facing the second plate and/or a side of the second plate facing the first plate is formed with a plurality of supporting structures, which include a plurality of supporting pillars and a plurality of supporting plates, by an etching process. Accordingly, the flowing speed of the evaporated working fluid can be increased, so that the heat conducting speed between the two plates can be improved so as to enhance the heat conducting ability. Therefore, the vapor chamber can have a thinner size and a good heat conducting efficiency, thereby providing a better heat conducting ability to the electronic product.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A slim vapor chamber, comprising:

a first plate;

a second plate, wherein a periphery of the second plate is connected with a periphery of the first plate to form a chamber; and a capillary structure disposed on an inner wall of the chamber, wherein at least one of a side of the first plate facing the second plate and a side of the second plate facing the first plate is formed with a plurality of first supporting structures and second supporting structures, which comprise a plurality of supporting pillars and a plurality of supporting plates, by an etching process, wherein the first supporting structure is longer than the second supporting structure in height, the first supporting structures are located within an area defined by boundaries of the second plate and contact against the other one of the sides of the first plate and the second plate to form a vapor space between the first supporting structures to increase a vapor flowing speed in the vapor space faster than in the rest of the chamber, and the second supporting structures contact against the capillary structure for backflow.

2. The slim vapor chamber of claim 1, wherein the first supporting structures and the second supporting structures are located within two regions, the supporting pillars are configured in one of the regions, and the supporting plates are configured in the other one of the regions.

3. The slim vapor chamber of claim 1, wherein at least one of the first supporting structures and the second supporting structures are a combination of the supporting pillars and the supporting plates, the supporting plates are arranged in rows, and the supporting pillars are disposed in intervals of the rows of the supporting plates.

4. The slim vapor chamber of claim 3, wherein the intervals of the rows of the supporting plates are ranged from 3 mm to 30 mm.

5. The slim vapor chamber of claim 1, wherein the supporting pillars are column pillars, cone pillars or reversed cone pillars.

6. The slim vapor chamber of claim 1, wherein a cross-section of the supporting pillar is circular, elliptic, triangular, rectangular, rhombic, trapezoidal, or polygonal.

7. The slim vapor chamber of claim 1, wherein the capillary structure is formed by a sintering process with a woven metal mesh or a metal powder.

8. The slim vapor chamber of claim 1, wherein a thickness of the slim vapor chamber is ranged from 0.2 mm to 0.6 mm.

9. A slim vapor chamber, comprising:

a first plate;

a second plate, wherein a periphery of the second plate is connected with a periphery of the first plate to form a chamber; and a capillary structure disposed on an inner wall of the chamber, wherein a side of the second plate facing the first plate is formed with a plurality of first supporting structures and second supporting structures by an etching process, wherein the first supporting structure is longer than the second supporting structure in height, the first supporting structures are located within an area defined by boundaries of the second plate and contact against the first plate to form a vapor space between the first supporting structures to increase a vapor flowing speed in the vapor space faster than in the rest of the chamber, and the second supporting structures contact against the capillary structure for backflow.

10. The slim vapor chamber of claim 9, wherein the first supporting structures and the second supporting structures comprise a plurality of supporting pillars and a plurality of supporting plates;

the first supporting structures and the second supporting structures are located within two regions of the second plate;

the supporting pillars are configured in one of the regions; and the supporting plates are configured in the other one of the regions.

11. The slim vapor chamber of claim 10, wherein the supporting plates are arranged in rows, and the supporting pillars are disposed in intervals of the rows of the supporting plates.

12. The slim vapor chamber of claim 11, wherein the intervals of the rows of the supporting plates are ranged from 3 mm to 30 mm.

13. The slim vapor chamber of claim 10, wherein the supporting pillars are column pillars, cone pillars or reversed cone pillars.

14. The slim vapor chamber of claim 10, wherein a cross-section of one of the supporting pillars is circular, elliptic, triangular, rectangular, rhombic, trapezoidal, or polygonal.

15. The slim vapor chamber of claim 9, wherein the capillary structure is formed by a sintering process with a woven metal mesh or a metal powder.

16. The slim vapor chamber of claim 9, wherein a thickness of the slim vapor chamber is ranged from 0.2 mm to 0.6 mm.

17. A slim vapor chamber, comprising:

a first plate;

a second plate, wherein a periphery of the second plate is connected with a periphery of the first plate to form a chamber; and a capillary structure disposed on an inner wall of the chamber, wherein a side of the second plate facing the first plate is formed with a plurality of first supporting structures and second supporting structures by an etching process, wherein the first supporting structure is longer than the second supporting structure in height, the first supporting structures contact against the first plate, and the second supporting structures contact against the capillary structure for backflow, wherein the first supporting structures and the second supporting structures comprise a plurality of supporting pillars and a plurality of supporting plates, the first supporting structures and the second supporting structures are located within two regions of the second plate, the supporting pillars are configured in one of the regions; and the supporting plates are configured in the other one of the regions, wherein the supporting plates are arranged in rows, and the supporting pillars are disposed in intervals of the rows of the supporting plates.

* * * * *